United States Patent [19]

Fender

[11] 4,252,182

[45] Feb. 24, 1981

[54] TUBE SHEET SHIELD

[75] Inventor: David A. Fender, Harleysville, Pa.

[73] Assignee: Ecolaire Incorporated, Malvern, Pa.

[21] Appl. No.: 22,256

[22] Filed: Mar. 20, 1979

[51] Int. Cl.[3] ..... F28F 9/18; F28F 21/08

[52] U.S. Cl. ..... 165/11 R; 165/70; 165/134 R

[58] Field of Search ..... 165/11, 70, 134, DIG. 8, 165/11 R, 134 R

[56] References Cited

U.S. PATENT DOCUMENTS

| | | | |
|---|---|---|---|
| 2,164,628 | 7/1939 | Sibley | 165/134 R |
| 2,658,728 | 11/1953 | Evans, Jr. | 165/11 |
| 2,893,701 | 7/1959 | Bell | 165/70 |
| 3,114,415 | 12/1963 | Wintzer | 165/158 |
| 3,326,279 | 6/1967 | Eisberg et al. | 165/134 R |
| 3,465,727 | 9/1969 | Tidball | 165/70 |
| 3,945,431 | 3/1976 | Straub | 165/11 |
| 4,140,172 | 2/1979 | Corey | 165/134 R |
| 4,182,408 | 1/1980 | Laber | 165/70 |

FOREIGN PATENT DOCUMENTS

| | | | |
|---|---|---|---|
| 758133 | 9/1956 | United Kingdom | 165/70 |

*Primary Examiner*—Sheldon Richter

*Attorney, Agent, or Firm*—Seidel, Gonda, Goldhammer & Panitch

[57] ABSTRACT

The tube sheet of a heat exchanger supports a plurality of tubes made from a material such as titanium. A shield is provided for the tube sheet and is welded to the tubes. The shield is made from the same material as the tubes and is spaced from the tube sheet to define a fluid chamber containing fluid at a pressure in excess of the pressure of the liquid flowing through the tubes.

7 Claims, 2 Drawing Figures

TUBE SHEET SHIELD

BACKGROUND

In some heat exchangers, particularly large steam surface condensers, it is desirable to make the tubes from a material such as titanium. One reason that titanium is desirable as the material for the tubes is its high resistance to the corrosive effects of saltwater. Heretofore, it has been conventional to roller expand the ends of the tubes into the tube sheets supporting the tubes. Roller expanding titanium tubes is an inexact art, due to the high ductility of the material, and the prevention of leakage from the shell side is difficult to guarantee. An effective seal is attained only when the tubes are welded to the tube sheet. If the tubes are of titanium, then, since titanium can only be welded to itself, it follows that the tube sheet should also be made of titanium.

In a large heat exchanger such as a steam condenser, the tube sheet is about 25 to 50 millimeters thick and the area of its major faces is about 150 to 250 square feet. There is currently no known domestic source of supply for a tube sheet of titanium and having such dimensions. Even if there was a source of supply, the cost would be prohibitive. Further, due to the high degree of cleanliness required, it would be impractical to obtain reliable welds between the tubes and the tube sheet of a large heat exchanger.

If one attempts to expand titanium tubes into a tube sheet made from another material, there is a high likelihood that the difference in the material in cooperation with the liquid flowing through the tubes will create a battery action. In such battery action, the material from the tube sheet plates onto the inner surface of the tubes, eroding the tube sheet, and creating a passageway for inleakage. After a period of time, it often becomes necessary to repair, plug, or retube the heat exchanger.

The present invention is directed to a solution of the problem of how to structurally interrelate a tube sheet and tubes in a heat exchanger wherein the tubes are made from titanium or an alloy having similar corrosion resistance in a manner which avoids a battery action, and results in reliable welds capable of being monitored.

SUMMARY OF THE INVENTION

The present invention is directed to a heat exchanger of the type wherein first and second tube sheets are supported within a shell. Tubes are supported by the tube sheets. The tubes are mechanically coupled to the first tube sheet and extend therebeyond so that the free ends of the tubes are spaced from a side face of the tube sheet by a substantially uniform distance. A flat flexible shield is generally parallel to said face of the tube sheet. The shield is perforated with the holes therein circumscribing a discrete tube end portion at its free end. A discrete weld joins each of said tube end portions to the shield.

A means is provided for sealing the periphery of the shield and the shell whereby a hermetically sealed chamber is provided between the shield and said face of the tube sheet. The thickness of the tubes is approximately equal to the thickness of the shield. The shield and tubes are of the same material. The tube sheet is of a material different from the material of the tubes and shield. The thickness of the tube sheet is at least 20 times the thickness of the shield. The distance between the shield and tube sheet face is preferably 3 to 10 times the thickness of the shield.

It is an object of the present invention to provide a heat exchanger with a novel interrelationship of a tube sheet and tubes supported thereby wherein the tube sheet and tubes are of different materials without incurring a battery action and at the same time providing reliable welds between a shield and the tubes.

It is another object of the present invention to provide a novel arrangement for supporting tubes by way of a tube sheet in a heat exchanger in a manner which minimizes corrosion and provides for monitoring of contamination.

Other objects will appear hereinafter.

For the purpose of illustrating the invention, there is shown in the drawings a form which is presently preferred; it being understood, however, that this invention is not limited to the precise arrangements and instrumentalities shown.

Figure 1:
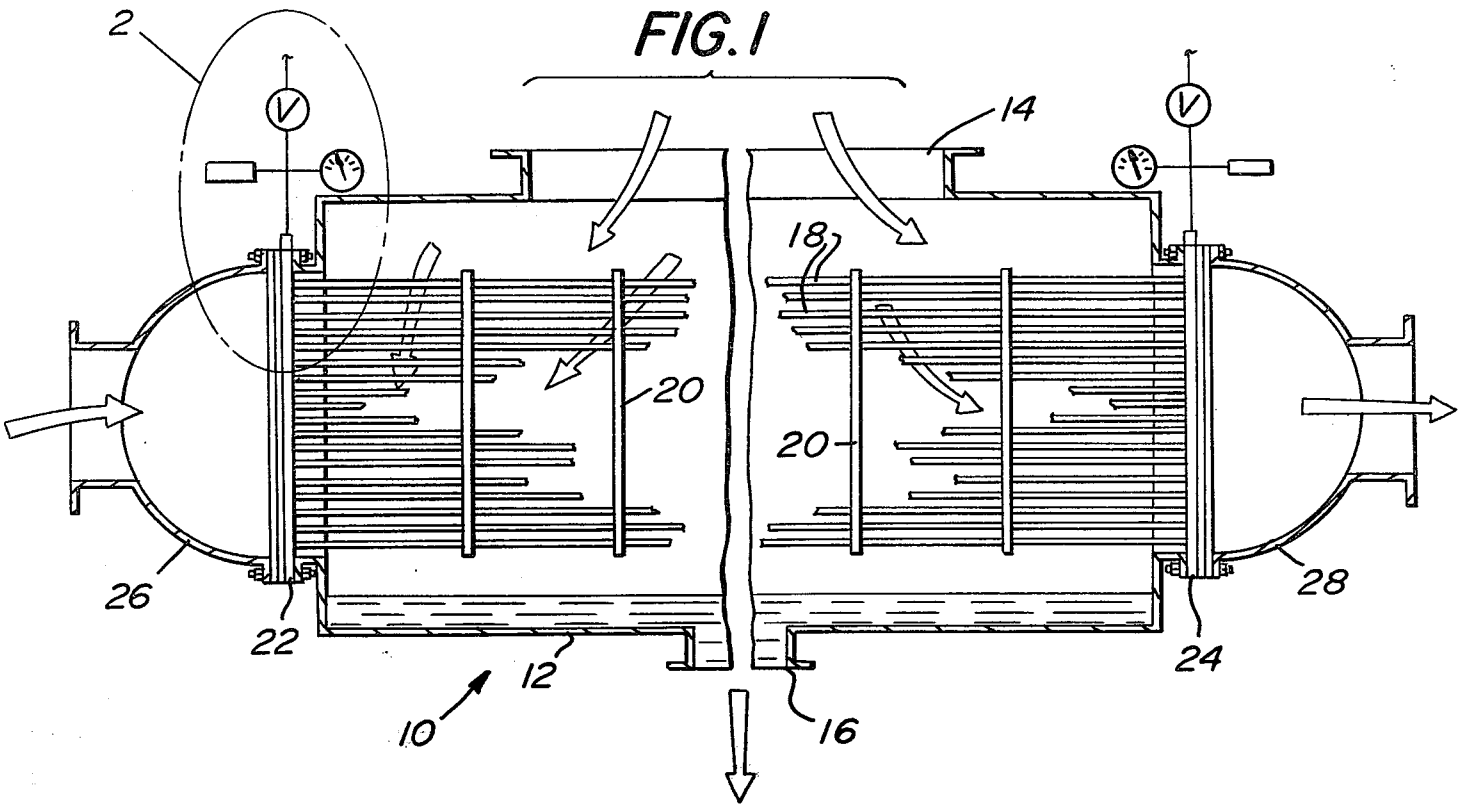
FIG. 1 is a longitudinal sectional view of a typical heat exchanger incorporating the present invention.

Referring to the drawings in detail, wherein like numerals indicate like elements, there is shown in FIG. 1 a heat exchanger designated generally as 10. The heat exchanger 10, such as a steam condenser, includes a shell 12 having a fluid inlet 14 and a liquid condensate outlet 16. Within the shell 12, there is provided a plurality of parallel tubes 18. The tubes 18 are supported along their length by tube support plates 20. At their end portions, the tubes 18 are supported by tube sheets 22 and 24. A liquid is introduced into the tubes 18 adjacent the tube sheet 22 by a channel member 26. The liquid exits from the tubes 18 by way of a channel member 28. The directions with respect to fluid flow are indicated by the arrows in FIG. 1.

Figure 2:
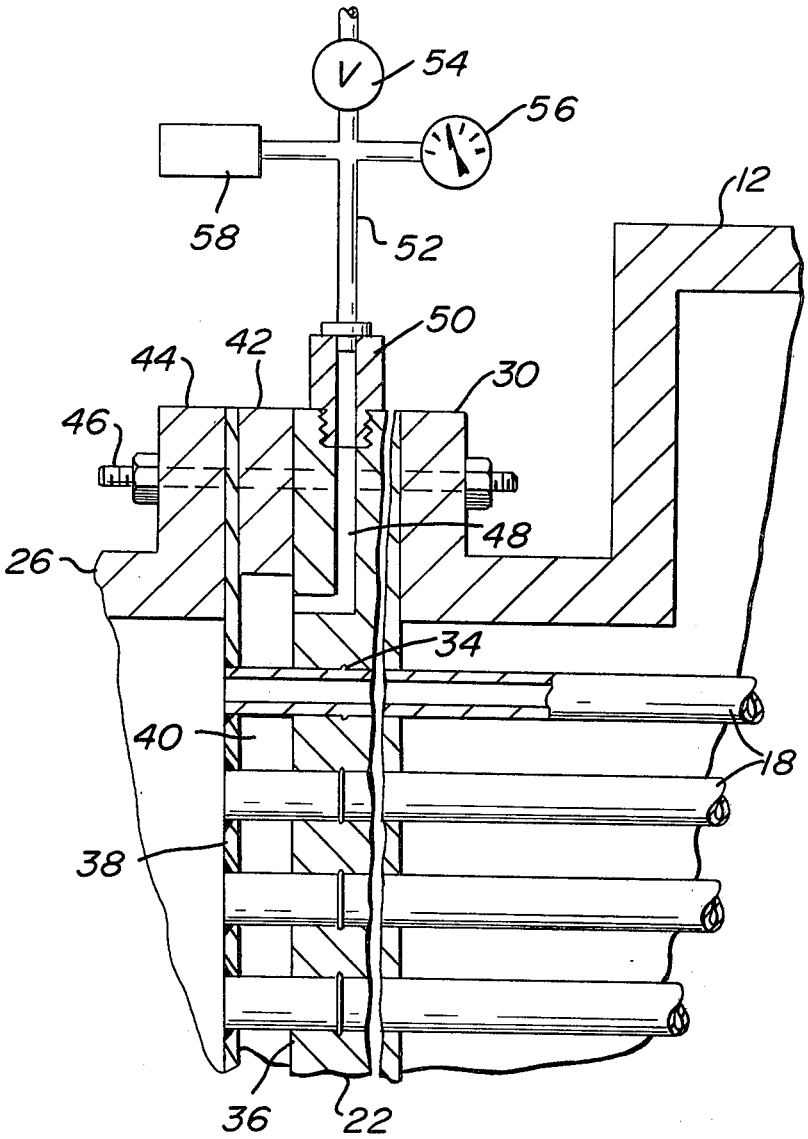
FIG. 2 is an enlarged detail view of the structure circumscribed by the circle in FIG. 1.

The arrangement with respect to the tube sheets 22, 24 is identical. Hence, only tube sheet 22 will be described in detail. Referring to FIG. 2, it will be noted that the tube sheet 22 is juxtaposed to a flange 30 on the shell 12. The tubes 18 are mechanically coupled to the tube sheet 22 with a tight seal by means of roller expansion. As illustrated, expansion of the tube 18 into the tube sheet 22 can be enhanced by use of a serration 34 whereby the material of the tube flows radially outwardly into this serration 34 on the inner peripheral surface of the bore in tube sheet 22. A typical serration 34 is 0.062 inch wide and 0.010 to 0.025 inch deep.

It will be noted that each tube 18 extends beyond the side face 36 of the tube sheet 22. A flat flexible shield 38 is disposed parallel to and spaced from the face 36. Shield 38 is perforated in the pattern of the tubes 18 so that each end of each tube 18 extends into a hole in the shield 38 and is welded thereto.

The shield 38 is spaced from the face 36 to define a chamber 40. A spacer 42 is provided at the periphery of tube sheet 22 and shield 38. The thickness of spacer 42 corresponds to the width of the chamber 40. Flange 44 on the channel member 26 overlies the outer peripheral portion of the shield 38. A bolt 44 or some equivalent structure is provided to removably interconnect the shell 12, tube sheet 22, spacer 42, shield 38, and channel member 26.

One or more passageways 48 are provided in the tube sheet 22 to facilitate communication with the chamber 40. Passageway 48 may be attained by drilling a hole radially inwardly from the outer peripheral surface of tube sheet 22 and then drilling an axial hole at a location whereby the two holes will meet with one another. Other arrangements may be made to provide communication with the chamber 40 such as by way of radial holes in the spacer 42.

A fitting 50 is coupled to the tube sheet 22 in line with the passageway 48. Fitting 50 is connected to a conduit 52 having a valve 54. A variety of different indicating devices may be connected to conduit 52 in communication therewith such as the pressure gauge 56 and the sensor 58.

The preferred embodiment of the present invention is to make the tubes 18 and shield 38 from a material such as titanium. The wall thickness of the shield 38 corresponds to the thickness of the tubes 18. So long as shield 38 and tubes 18 are made from the same material having approximately the same thickness, they may be made from other materials such as special alloys, stainless steel, etc.

The tube sheet 22 is made from an inexpensive material different from the material used for tubes 18 and shield 38. Thus, tube sheet 22 may be made from a low carbon steel. Tube sheet 22 has a thickness which is 20 to 50 times as great as the thickness of the shield 38. The chamber 40, in an axial direction with respect to the tubes, has a dimension which is approximately 3 to 10 times the thickness of the shield 38. Shield 38 in a preferred embodiment has a thickness of 1 millimeter.

With the tubes 18 and shield 38 made from titanium, they are welded together using an inert gas welding method. The chamber 40 facilitates exposing the weld areas on one side of shield 38 to inert gas by way of conduit 52 and passageway 48. The inert gas assists in attaining the welds between the shield 38 and the tubes 18. The inert gas at a pressure substantially above atmospheric pressure may remain in chamber 40 if desired to facilitate monitoring the integrity of the welds and any contamination therein which would be indicative of a leaker. The pressure of the inert gas within chamber 40 can be monitored by way of gauge 56 and any contaminants therein may be monitored by way of sensor 58. If desired, chamber 40 may be flooded with a pressurized liquid. Since the chamber 40 is hermetically sealed and contains a fluid at a pressure substantially above the pressure of the liquid flowing through the tubes 18, shield 38 can be made from material as thin as 1 millimeter. Since the tube sheet 22 is not exposed to the corrosive action of the liquid flowing through tubes 18, no battery action can occur between the tube sheet 22 and the tubes 18.

As a result of the present invention, a battery action is avoided and reliable welds can be attained since the materials being welded are identical and have substantially the same wall thickness with the weld areas being accessible to exposure to an inert gas. Since the portion of the tubes 18 to be welded project beyond the face 36 of the tube sheet 22, they are more readily accessible for attaining the cleanliness necessary to obtain a good weld.

The present invention may be embodied in other specific forms without departing from the spirit or essential attributes thereof and, accordingly, reference should be made to the appended claims, rather than to the foregoing specification, as indicating the scope of the invention.

I claim:

1. In a heat exchanger comprising a shell, first and second tube sheets supported in said shell, parallel tubes supported by and sealed to said tube sheets, each tube extending through a discrete hole in said first tube sheet and extending therebeyond so that the free ends of the tubes are spaced from a side face of the tube sheet by a substantially uniform distance, a flat flexible shield generally parallel to said side face and spaced therefrom, a chamber between said tube sheet side face and said shield, said shield being perforated with the holes therein circumscribing a discrete end portion of said free ends of said tubes, a discrete weld joining each tube end portion to said shield, means sealing the periphery of said shield and said first tube sheet so that said chamber is hermetically sealed, the thickness of said tubes being approximately equal to the thickness of said shield, said shield and tubes being of the same material, said tube sheet being a material different from the material of said tubes, the thickness of said tube sheet being at least 20 times as thick as said shield.

2. In a heat exchanger in accordance with claim 1 wherein the length of said chamber in an axial direction with respect to said tubes is between 3 and 10 times the thickness of said shield, and said chamber containing a pressurized fluid.

3. In a heat exchanger in accordance with claim 1 wherein said shield and tubes are titanium and said tube sheet being low carbon steel.

4. In a heat exchanger in accordance with claim 1 wherein said tube sheet contains a passageway from said chamber to an instrument outside said shell for monitoring the characteristics of pressurized fluid in said chamber.

5. In a heat exchanger in accordance with claim 1 wherein said shield and tubes have a thickness of approximately 1 millimeter.

6. A heat exchanger comprising a shell, first and second tube sheets supported in said shell, parallel tubes supported by and sealed to said tube sheets, each tube extending through a discrete hole in said first tube sheet and extending therebeyond so that the free ends of the tubes are spaced from a side face of the tube sheet by a substantially uniform distance, a flat flexible shield generally parallel to said side face and spaced therefrom, a pressurized chamber between said tube sheet side face and said shield, said shield being perforated with each of the holes therein concentric with a free end of one of said tubes, a discrete weld joining the free end of each tube to said shield, means sealing the periphery of said shield and said first tube sheet so that said chamber is hermetically sealed, the thickness of said tubes being approximately equal to the thickness of said shield, said shield and tubes being of titanium, said tube sheet being a material different from and being thicker than the material of said tubes, means outside said shell for monitoring a characteristic of the pressurized fluid in said chamber, said shell having an inlet and an outlet for enabling a fluid flowing therebetween to be in heat transfer relation with said tubes.

7. In a heat exchanger in accordance with claim 6 wherein the length of said chamber in an axial direction with respect to said tubes is between 3 and 10 times the thickness of said shield, and said tube sheet thickness being 20 to 50 times the thickness of said shield.

* * * * *